US005689923A

United States Patent [19]

Winkeljann et al.

[11] Patent Number: 5,689,923

[45] Date of Patent: Nov. 25, 1997

[54] DEVICE FOR SECURING STEEL REINFORCING OR PRESTRESSING MEMBERS IN AN ANCHORAGE

[75] Inventors: Antonius Winkeljann, Landsberg; Werner Kaibach, Buchloe; Franz Böhm, Kaufering, all of Germany

[73] Assignee: Hilti Aktiengeschaft, Fürstentum, Liechtenstein

[21] Appl. No.: 630,190

[22] Filed: Apr. 10, 1996

[30] Foreign Application Priority Data

Apr. 11, 1995 [DE] Germany ..... 195 13 202.5

[51] Int. Cl.[6] ..... E04C 3/10

[52] U.S. Cl. ..... 52/223.13; 52/726.1; 52/223.14

[58] Field of Search ..... 52/223.13, 223.14, 52/726.1, 740.1–740.9, 414, 600, 745.21

[56] References Cited

U.S. PATENT DOCUMENTS

| | | | |
|---|---|---|---|
| 3,139,730 | 7/1964 | Williams . | |
| 4,114,344 | 9/1978 | Heasman | 52/740.3 X |
| 4,363,462 | 12/1982 | Wlodkowski et al. | 52/223.13 X |
| 4,718,209 | 1/1988 | Hanesen et al. | 52/223.13 |

FOREIGN PATENT DOCUMENTS 1240019 5/1967 Germany .

*Primary Examiner*—Carl D. Friedman
*Assistant Examiner*—Beth A. Aubrey
*Attorney, Agent, or Firm*—Anderson Kill & Olick, P.C.

[57] ABSTRACT

A device for locking steel reinforcing or prestressing members (15) in a positive manner in an anchorage (14) includes an axially extending cylindrical anchoring sleeve (1) with a throughbore (2) and a deformation section (3) extending from a leading end in the setting direction (S) and divided by axially extending slots (4) into at least six bending elements (5). An expanding element (8) with a throughbore (9) free of threads has a contact surface (10) for the bending elements (5) and the contact surface is inclined relative to the axis A of the anchoring sleeve (1). The expanding element (8) can be displaced against the deformation section (3) for spreading the bending elements (5) radially outwardly against the receiving surface of a receiving bore in a base material forming the anchorage. The contact surface (10) forms an angle (α) with the axis (A) of the anchoring sleeve (1) in a range of approximately 30° to 80°. The axial length of the bending elements is dimensioned, so that the outside diameter of the leading end of the deformation section in the anchored state amounts to 140%, at a maximum, of such diameter in the unexpanded state. The securement of the anchoring sleeve (1) is achieved by a positive lock in an undercut formed in the receiving bore in the base material.

6 Claims, 2 Drawing Sheets

DEVICE FOR SECURING STEEL REINFORCING OR PRESTRESSING MEMBERS IN AN ANCHORAGE

BACKGROUND OF THE INVENTION

The present invention is directed to a device for securing reinforcing or prestressing members in an anchorage or base material and includes a cylindrical anchoring sleeve having a throughbore and an axially extending deformation section subdivided into bending elements by axially extending slots located at its leading end region in the setting direction. An expansion element free of any threads is provided with a throughbore and it has a contact surface for the bending elements which surface is inclined relative to the axis of the anchoring sleeve and is arranged so that it can be displaced against the deformation section of the anchoring sleeve providing plastic deformation.

In building construction involving underground work, it is often necessary to secure reinforcing or prestressing members into an anchorage or base material. Such work is carried out during rehabilitation of concrete structures or to establish a load carrying connection between completed buildings and new buildings or building extensions. In anchoring technology known in the state of the art, the anchorage is completely pierced. Subsequently, the reinforcing or prestressing members are passed through the pierced portion and anchored on the side of the anchorage facing away from the load by screwing on special nuts or prestressing connections and supporting washers. Such anchoring technology can only be used, however, when the side of the anchorage facing away from the load is accessible. In foundations, for instance, this anchoring technology cannot be utilized.

The chemical attachment of steel reinforcing or prestressing members in a receiving bore is an additional method known in the state of the art for securing the reinforcing or prestressing members at a later time within an anchorage. Initially, a cylindrical receiving bore is formed and is filled with an inorganic or organic mortar. The reinforcing or prestressing member is then inserted into the receiving bore. If large diameter reinforcing or prestressing members are required, the receiving bores must be produced by diamond tipped annular drill bits or crown bits. As a result, the surface of the receiving bore is very smooth and must be roughened prior to inserting the mortar to provide a surface for holding the mortar. Chemical anchoring of reinforcing or prestressing members can cause problems, if the anchorage has already been fractured or cracked, for instance, during rehabilitation work, since the mortar connections do not in all cases favorably bridge the ruptures on cracks. If the crack in the anchorage opens up further, chemical anchoring can be used only conditionally, and in the worst case failure of the anchoring device can occur.

A rock anchor for ceilings in mines, tunnels or the like is disclosed in DE-D-1 240 019, such a lock anchor has an expansion sleeve with a throughbore, an axially slotted expansion section and an expansion cone with a throughbore free of any threads. The expanding cone and the expansion sleeve are pushed one after the other onto an anchoring rod on which a nut is threaded at its leading end, that is, in the setting direction. The diameter of the nut is selected to be larger than the diameter of the throughbore in the expanding cone. In order to expand this rod anchor, the position of the expansion sleeve is fixed in the receiving bore and the anchoring rod is pulled. As a result, the expanding cone is displaced onto the leading end section of the expansion sleeve by a shoulder formed on the nut. The outer circumference of the axially slotted expansion sleeve is expanded and anchored in the receiving bore by a frictional lock. Such a device cannot be used in all types of anchorages, because of the considerable expansion forces involved. If these anchoring devices are used, specific minimum edge spacings are required with this type of anchoring, because of the expansion pressure. In the case of formation of cracks, such anchoring devices secured by frictional locking are unable to carry the required loads. These anchoring devices are unsuitable for use in anchorages or base materials which are already in a cracked condition.

SUMMARY OF THE INVENTION

Therefore, it is the primary object of the present invention to provide a device for securing steel reinforcing or prestressing member in an anchorage or base material so that the above mentioned disadvantages are avoided. The device is suitable for effecting subsequent anchorings. It assures a secure anchoring of the reinforcing or prestressing members independently of the accessibility of the side of the anchorage facing away from the side on which the load is applied. The device affords, when the anchorage or base material is cracked, a sufficiently large force transmission area for introducing a load and is capable of bridging over cracks. In particular, it is usable for rehabilitation of previously cracked anchorages. The device permits the fastening of reinforcing or prestressing members in the anchorage independently of the nature of their surfaces. High installation forces for effecting the anchoring can be avoided. Cracks in materials in the anchoring device are to be avoided.

In accordance with the present invention, a device is provided for anchoring steel reinforcing or prestressing members in an anchorage or base material comprising an axially extending cylindrical anchoring sleeve having a throughbore and an axially extending deformation section subdivided into bending elements by axial slots in its leading end region in the setting direction. The device also includes an expanding element with a throughbore free of any threads, which element has a contact surface for the bending elements inclined relative to the axis of the anchoring sleeve, so that the bending elements can be displaced radially outwardly against the surface of a receiving bore in the anchorage. According to the invention, the anchoring sleeve is anchored or secured by a positive lock in an undercut in the receiving bore where the contact surface is formed at an angle with the axis of the anchoring sleeve in the range of about 30° to 80° and where the deformation section is formed by at least six bending elements whose axial length is dimensioned so that the outside diameter of the deformation section at its leading end in the anchored state amounts to 140% at the most of its outside diameter in the unexpanded state.

With positively locked anchoring, there is the advantage, in the unloaded state, that the device is not subject to expansion forces. No specific marginal spaces are to be observed in this type of anchoring. The device can also be used in concrete already in a cracked condition, because of the positive locked anchoring of the anchoring sleeve. The angle of inclination of the contact surface of the expanding element of approximately 30° to 80° affords a relatively strong deformation of the bending elements relative to the axial extent of the anchoring sleeve. After the bending elements are deformed, a sufficiently large force transmittal area for the introduction of forces is available, and the formation or widening of cracks can be bridged, due to the angle of inclination and the enlarged outside diameter of the deformation section. The anchoring occurs by a plastic deformation of the bending elements. In spite of the pronounced deformation of the bending elements, the elongation forces occurring at the bending points of the bending elements can be kept within bounds by subdividing the deformation section of the anchoring sleeve into at least six bending elements formed by means of axially extending slots in the sleeve. In this manner, cracks in the material of the deformation section of the anchoring sleeve can be avoided. The installation forces required for anchoring the anchoring sleeve could also be kept relatively low by the division of the deformation section into at least six bending elements. The device embodying the present invention is suited for later anchorings and enables a secure anchorage of steel reinforcing or prestressing anchors independently of the accessibility of the side of the anchorage facing away from the side at which the forces are applied. The expanding element with its thread-free through bore permits attachment of reinforcing or prestressing members independently of their surface character. The diameters of the reinforcing or prestressing members permit a larger possibility of variation in connection with the inventive device.

In a preferred embodiment of the device, the angle of inclination is in the range of 35° to 45° and the deformation section has eight or more bending elements. This arrangement permits a still further reduction in the deformation forces generated at the bending points of the bending elements. At the same time, the required installation forces are also reduced.

Preferably, the deformation section is provided with a circumferential perforation. The perforation determines the bending points of the bending elements. Plastic joints are formed at the bending points due to the circumferential perforation so that irreversible deformations occur in the course of anchoring the anchoring sleeve. The forces required for installing the device are also reduced.

It is advantageous if the anchoring sleeve is chamfered in the region of the perforation in the outside surface of the anchoring sleeve, with the angle of chamfer corresponding at least to half the angle of the inclination of the contact surface of the expanding element. In the course of the plastic deformation in the bending region of the bending elements, the chamfered surfaces come in contact with one another. In this way, the bending elements can abut at the anchoring sleeve so that their strength is increased along with the load carrying ability of the anchoring device.

In an embodiment of the invention which is particularly easy to fabricate, the contact surface of the expansion element is shaped as a conical surface. Because of the required high strength, the anchoring sleeve and the expanding element are preferably formed from metal.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
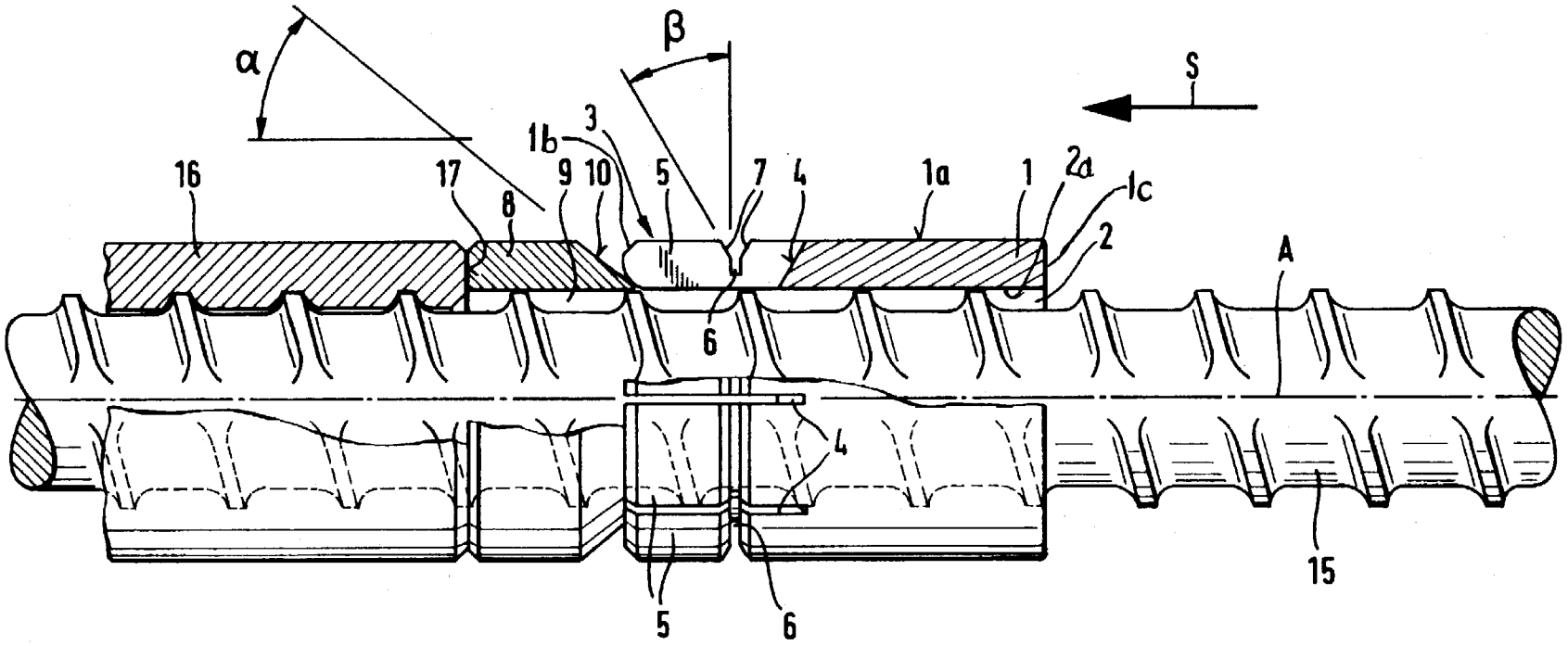
FIG. 1 is a partial axially extending view of a steel reinforcing member with the device of the invention placed on it and shown partially in section.

The inventive device shown in FIG. 1 for anchoring a steel reinforcing or prestressing member 15 in an anchorage or base material comprises an axially extending cylindrical anchoring sleeve 1 having a first end 1*b*, the left hand end in FIG. 1, and a second end 1*c*, the right hand end. A throughbore 2 extends from the first to the second end. The throughbore has an inside surface 2*a* facing the member 15 and the anchoring sleeve has an outside surface 1*a*. Preferably, the inside surface of the throughbore is free of threads. The anchoring sleeve 1 has an axially extending deformation section 3 extending from the first end towards the second end and the setting direction S of the sleeve is shown by an arrow. Deformation section 3 is divided by axially extending slots 4 into bending elements 5. In addition, the device includes an annular expanding element 8 also provided with a throughbore 9 free of threads. Expanding element 8 has a first end on the left in FIG. 1 and a second end on the right. At its second end, the expansion element 8 has a contact surface 10 facing the bending elements 5 and the contact surface is inclined relative to the axis A of the anchoring sleeve 1. In the example shown in FIG. 1, the contact surface 10 is conically-shaped. It would also be possible to form the contact surface 10 as a chamfered surface. The angle of inclination $\alpha$ defined between the contact shaped surface 10 and the axis A of the anchoring sleeve 1 is in the range of approximately 30° to 80° and, more specifically, approximately 35° to 45°.

The deformation section 3 of the anchoring sleeve 1 has at least six bending elements 5. Preferably, eight or more bending elements form the deformation section. The outside surface of the anchoring sleeve 1 has a circumferentially extending perforation or slot 6 in the deformation section 3 and serves as a plastically deformable joint for the bending elements. The perforation 6 has transition regions 7 extending inwardly from the outside surface into the perforation 6 and the transition regions are chamfered. The angle of chamfer $\beta$ amounts to at least half of the angle of inclination $\alpha$ of the contact surface 10 of the expanding element 8. The axial length of the bending elements 5 is measured from the bending point at the perforation 6 to the first end contacted by the contact surface 10 of the expanding element 8. As shown in FIG. 1, the bending point is determined by the circumferentially extending perforation 6. The axial length of the bending element 5 is dimensioned so that the outside diameter of the deformation section 3 in the anchored state amounts to 140% at a maximum of the outside diameter in the non-anchored or unexpanded state. The maximum diameter can be noted in FIG. 2 where the bending elements are expanded radially outwardly.

The anchoring sleeve 1 and the expanding element 8 are placed or slid over a reinforcing or prestressing member 15 as shown in the embodiment in FIG. 1. The surface of the steel reinforcing or prestessing member has a thread-like configuration. A coupling bushing 16 is placed or threaded onto the front region of the steel reinforcing or prestressing member 15, that is, the front region in the setting direction S. For this purpose, the coupling bushing 16 is provided with an inside thread matched to the threaded surface of the reinforcing or prestressing member 15. The trailing end of the coupling bushing 16, relative to the setting direction, forms a shoulder 17 in contact with the end of the expanding element 8 opposite the end forming the contact surface 10.

Figure 2:
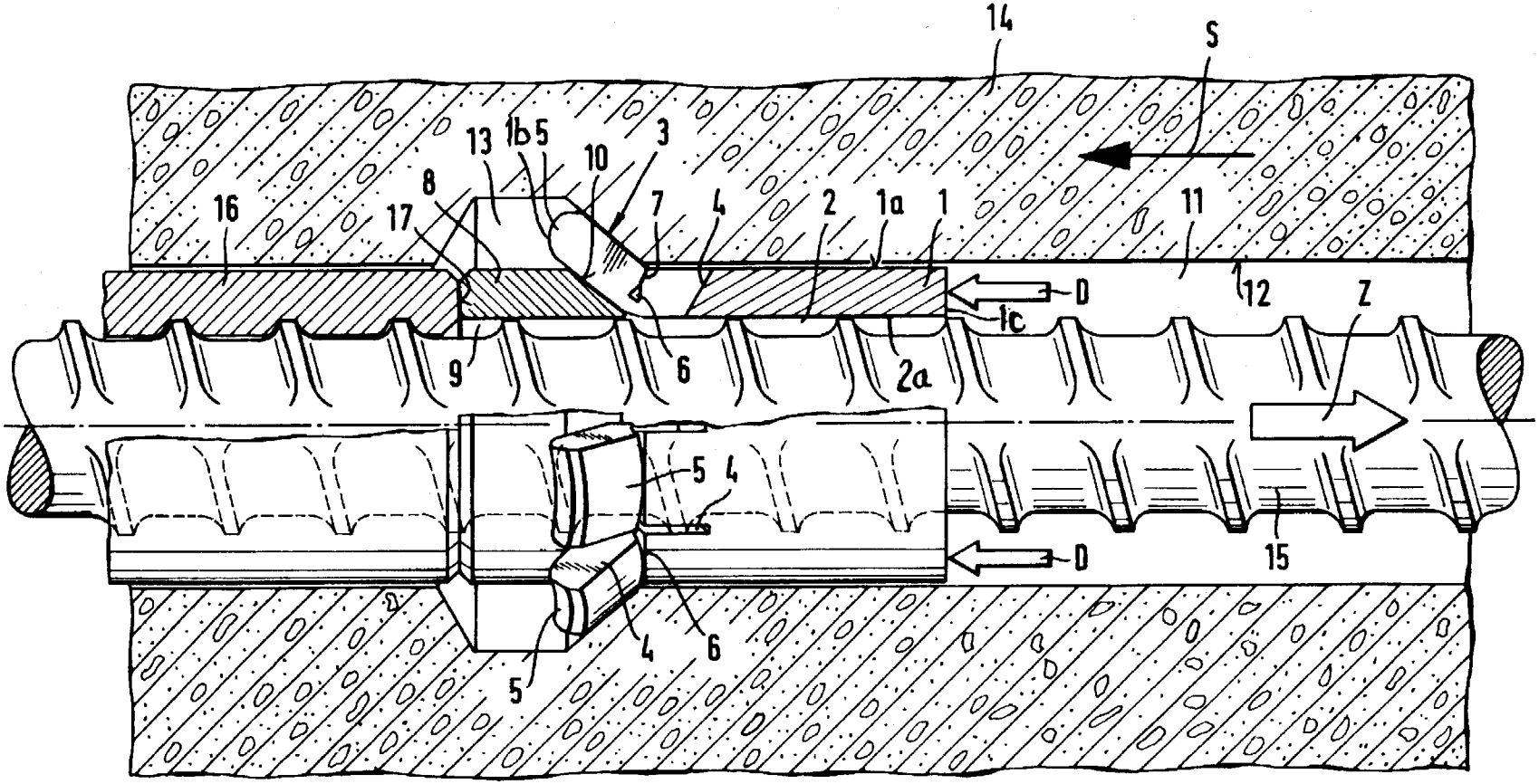
FIG. 2 is an axially extending view similar to FIG. 1 with the device of the present invention anchored in a receiving bore in an anchorage.

In FIG. 2 the reinforcing or prestressing member 15 is anchored by the inventive device in a receiving bore 11 in an anchorage or base material 14, formed of concrete. To provide a suitable receiving bore 11, an axially extending cylindrical borehole is formed in the anchorage 14 extending in the setting direction S. Subsequently, an undercut 13 is formed in a known manner at a desired depth of the receiving bore 11. When forming the undercut 13, it must be noted that the cylindrical borehole length inwardly from the undercut has a sufficient length to receive the coupling bushing 16 and the expanding element 8 in the unexpanded or unanchored state of the anchoring sleeve 1. To anchor the anchoring sleeve placed on the steel reinforcing or prestressing member 15, its position is adjusted so that the perforation is located approximately 1 mm to 10 mm inwardly from the trailing edge of the undercut 13. Such positioning can be effected by providing the anchoring sleeve with an appropriate length, so that a collar at the trailing end of the sleeve abuts the outside surface of an anchorage or base material 14. If a short anchoring sleeve is used, an additional pipe can be placed on the reinforcing or prestressing member 15, trailing the anchoring sleeve, with the pipe sufficiently long to project beyond the surface of the anchoring base. The surface of the pipe can be calibrated with marks on its outside surface for affording a precise adjustment of an anchoring sleeve 1.

Anchoring sleeve 1 is secured or anchored by applying a pulling force Z directed opposite to the setting direction S, on the reinforcing or prestressing member 15 projecting out of the receiving bore 11. Simultaneously, a counter force D, in the setting direction S, is applied to the second end of the anchoring sleeve and retains the sleeve in position. The applied pulling or tensile force Z is transmitted to the expanding element 8 through the shoulder 17 on the trailing end of the coupling bushing 16 screwed onto the steel reinforcing a prestressing member 15 and, as a result, the expanding element 8 is driven into the deformation section 3 of the anchoring sleeve 1 and effects the plastic deformation of the bending elements 5. Accordingly, bending elements 5 are expanded radially outwardly in the region of the undercut 13 against the surface 12 borehole 11, and, as shown in FIG. 2, their chamfered transition regions 7 abut at the radially outer surfaces of the perforation or slot 6. The outside diameter of the deformation section 3, at the first end of the anchoring sleeve 1, in the anchored state amounts at the maximum, to 140% of the outside diameter of the sleeve in the unanchored or unexpanded state.

The device of the present invention can be used on steel reinforcing prestressing members of different diameters. The thread-free throughbore 2 of the anchoring sleeve 1 and of the expanding element 8 permit the use of the device with reinforcing prestressing members having different surface characteristics. Only one suitable coupling bushing 16 or the like must be placed on the reinforcing or prestressing member so that the trailing end of the coupling bushing forms a shoulder for contacting with the first end of the expanding element 8. The fabrication of the receiving bore with its undercut is carried out in a known manner. The device of the present invention permits the formation of an anchorage free of expansion forces in the unloaded state. Generally, specific edge spacings may not be observed in the course of the anchoring process. This affords the possibility of placing a receiving bore in a region of the base material 14 where existing reinforcing materials are with certainty not severed. The device can also be used in concrete which is in a cracked condition due to the positively locked anchoring of the anchoring sleeve. The angle of inclination of the contact surface 10 of the expanding element 8 of approximately 30° to 80° affords a relatively strong deformation of the bending element for the axial extent of the anchoring sleeve. A sufficiently large force transmittal area is available for introducing a force due to the angle of inclination and the outside diameter of the deformation section in the anchored state, and any cracks formed in the formation or progression of the anchoring procedure can still be bridged. The anchoring takes place due to the plastic deformation of the bending elements. In spite of the pronounced deformation of the bending elements, the elongating forces arising at the bending points of the bending elements can be maintained within limits, by dividing the deformation section of the anchoring sleeve by axially extending slots into at least six bending elements. Such an arrangement prevents material fractures in the deformation section of the anchoring sleeve. The required installation forces for anchoring the anchoring sleeve can be kept relatively low by the division of the deformation section into at least six bending elements. The device of the present invention is suited for subsequent anchoring and enables a secure anchoring of steel reinforcing or prestressing members independently of the accessibility of the side of the anchorage or base material facing away from the side on which the load is applied.

While specific embodiments of the invention have been shown and described in detail to illustrate the inventive principles, it will be understood that the invention may be embodied otherwise without departing from such principles.

We claim:

1. A device for securing steel reinforcing or prestressing members (15) in an anchorage (14), the device comprising an axially extending cylindrical anchoring sleeve (1) having an axis (A), a first end, a second end, an inside surface and an outside surface, said anchoring sleeve (1) having a throughbore extending between the first and second ends and an axially extending deformation section (3) extending from the first end towards the second end, said deformation section being subdivided into at least six bending elements (5) by laterally spaced slots extending axially from the first end toward the second end, and said deformation section (3) having an unexpanded state and an expanded state, an annular expanding element (8) having an outside surface and an inside surface forming a throughbore (9) free of threads, said expanding element (8) having a first end and a second end with said second end arranged to contact the first end of said anchoring sleeve (1) and forming a contact surface (10) for the bending elements (5) at the first end of said anchoring sleeve, said contact surface (10) being inclined at an angle to the axis (A) of said anchoring sleeve, said expanding element being displaceable in the direction of the axis (A) against the deformation section (3) of said anchoring sleeve (1) for radially outwardly displacing said bending element (5) against a receiving bore (11) surface (12) in said anchorage, said anchoring sleeve (1) being arranged in the expanded state to be secured by a positive lock in an annular undercut in the receiving bore (11) against the anchorage (14), said contact surface forms an angle of inclination ($\alpha$) with the axis (A) of said anchoring sleeve in the range of approximately 30° to 80°, said deformation section (3) having a length in the axial direction of said anchoring sleeve so that the outside diameter of said bending elements at the first end of said anchoring sleeve in the expanded anchorage state amounts to at the maximum 140% of the outside diameter of the first end of said anchoring sleeve in the unexpanded state.

2. The device, as set forth in claim 1, wherein the angle of inclination ($\alpha$) is in the range of approximately 35° to 45° and said deformation section (3) comprises at least eight said bending elements (5).

3. The device, as set forth in claim 2, wherein the outside surface of said anchoring sleeve (1) is provided with a circumferentially extending perforation (6) spaced axially from the first end (1*b*) of said anchoring sleeve (1) and defining an end of said deformation section (3) spaced from the first end (1*b*) of said anchoring sleeve (1).

4. The device, as set forth in claim 3, wherein the outside surface of said anchoring sleeve (1) is chamfered at said perforation (6) and having an angle of chamfer ($\beta$) corresponding at least to half of the angle of inclination ($\alpha$) of the contact surface (10) of said expanding element (8).

5. The device, as set forth in claim 1 or 2, wherein said contact surface (10) of said expanding element (8) is shaped as a conical surface.

6. The device, as set forth in claim 1 or 2, wherein said anchoring sleeve (1) and said expanding element (8) are formed of metal.

* * * * *

UNITED STATES PATENT AND TRADEMARK OFFICE

CERTIFICATEOF CORRECTION

PATENT NO. : 5,689,923

DATED : November 25, 1997

INVENTOR(S) : Antonius Winkeljann, et al

It is certified that error appears in the above-identified patent and that said Letters Patent is hereby corrected as shown below:

Title page, item

{73} Assignee: Hilti Aktiengesellschaft, Fürstentum, Liechtenstein

Signed and Sealed this

Tenth Day of February, 1998

Bruce Lehman

*Attest:*

BRUCE LEHMAN

*Attesting Officer*

*Commissioner of Patents and Trademarks*